US007740400B2

(12) United States Patent
Membreno

(10) Patent No.: US 7,740,400 B2
(45) Date of Patent: Jun. 22, 2010

(54) CONTROL DRIP MIXER ATTACHMENT

(76) Inventor: Agustin J. Membreno, 1804 N. Amoult Rd., Metairie, LA (US) 70001

( * ) Notice: Subject to any disclaimer, the term of this patent is extended or adjusted under 35 U.S.C. 154(b) by 0 days.

(21) Appl. No.: 12/345,962

(22) Filed: Dec. 30, 2008

(65) Prior Publication Data

US 2009/0175123 A1 Jul. 9, 2009

Related U.S. Application Data

(60) Provisional application No. 61/010,054, filed on Jan. 4, 2008.

(51) Int. Cl.
*B01F 15/02* (2006.01)

(52) U.S. Cl. ..... 366/182.4; 366/183.1; 366/197

(58) Field of Classification Search ..... 366/182.1, 366/182.3, 182.4, 197, 183.1; 222/544–563, 222/465.1–475.1; 99/423
See application file for complete search history.

(56) References Cited

U.S. PATENT DOCUMENTS 1,646,614 A * 10/1927 Frye et al. ..... 222/146.5
1,947,364 A * 2/1934 Spino ..... 312/61
1,959,695 A * 5/1934 Sweetland ..... 222/157
2,042,928 A * 6/1936 Da Costa ..... 222/133
2,537,852 A * 1/1951 Peterson ..... 209/355
2,650,741 A * 9/1953 Van Guilder ..... 141/363
2,710,098 A * 6/1955 Tilton ..... 209/358
2,782,012 A * 2/1957 Coyne et al. ..... 366/182.1
3,257,170 A * 6/1966 Marcus et al. ..... 422/101
3,260,419 A * 7/1966 Weimer et al. ..... 222/309
4,023,602 A * 5/1977 Sparr, Sr. ..... 141/311 R
RE33,083 E * 10/1989 Pellegrino ..... 222/288
4,934,420 A * 6/1990 Radna ..... 141/340
5,462,203 A * 10/1995 Stern ..... 222/137
5,743,294 A * 4/1998 Donzella ..... 137/588
6,336,396 B1 * 1/2002 Sala ..... 99/423

* cited by examiner

*Primary Examiner*—Tony G Soohoo
(74) *Attorney, Agent, or Firm*—Daniel V. Thompson

(57) ABSTRACT

A control drip mixer attachment is in combination with a hub type food mixer. The control drip mixer attachment includes a container with a side wall and a bottom wall forming an interior of the container. A shaft is connected to the container, with the shaft being adapted and arranged to be removably inserted into a hub section of the mixer. An outlet opening is in fluid communication with the interior of the container near the bottom wall and is located vertically above the bowl of the mixer.

3 Claims, 3 Drawing Sheets

CONTROL DRIP MIXER ATTACHMENT

CROSS-REFERENCE TO PROVISIONAL APPLICATION

The benefit of U.S. Patent Application Ser. No. 61/010,054 filed 4 Jan. 2008 is claimed.

BACKGROUND OF THE INVENTION

The present invention relates in general to food preparation equipment. More specifically, but without restriction to the particular use which is shown and described, this invention relates to an accessory for a commonly-used commercial kitchen mixer.

Most commercial kitchens have an electric food service mixer. Commercial mixers do a lot of mixing chores and tasks. Most of these mixing machines are the type referred to as "Hub Type," such as a Hobart brand, type A200 mixer. This type of mixer has many variations but is characterized by a hub section in the upper top section of the mixer. The front part of this hub section has a round opening which can vary in size (diameter), depending on the capacity of the mixer.

The primary purpose of the hub section opening is to receive shaft type attachments, such as a slicer attachment, to be supported and powered by the mixer. Once inserted, the shaft type attachments are secured by a thumb screw which comes with the mixer. The mixers come in different sizes and capacities. The attachments have drive shafts that engage rotary machinery inside the mixer hub, to provide rotary power to the attachment to drive, for example, the slicer blade in the attachment.

One of the primary functions of these commercial food service mixers is the making of sauces and dressings. Many of these sauces and dressings are made from scratch with individual ingredients. Some of these ingredients have different absorption qualities and will not blend well if the ingredients are poured in all together at the same time and rate into the mixing bowl. Thus, some of these ingredients have to be slowly dripped into the mixing bowl in order to achieve a consistent uniform desired blend while the ingredients are being stirred in the mixing bowl. This procedure currently requires an individual cook to stand over the mixing bowl, with the mixer in operation, and slowly drip the necessary ingredients manually over a period of time in order to achieve a quality end product. One recipe might require the individual to stand at the mixer and slowly drip in an ingredient for as long as 20 minutes per batch. This is an inefficient use of skilled cooking labor. Hence, there is a need for a "Control Drip Mixer Attachment."

SUMMARY OF THE INVENTION

A control drip mixer attachment is in combination with a hub type food mixer. The control drip mixer attachment includes a container with a side wall and a bottom wall forming an interior of the container. A shaft is connected to the container, and the shaft is adapted and arranged to be removably inserted into a hub section of the mixer. An outlet opening is in fluid communication with the interior of the container near the bottom wall of the container, and the outlet opening is located vertically above a mixer bowl of the mixer.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION

Figure 4:
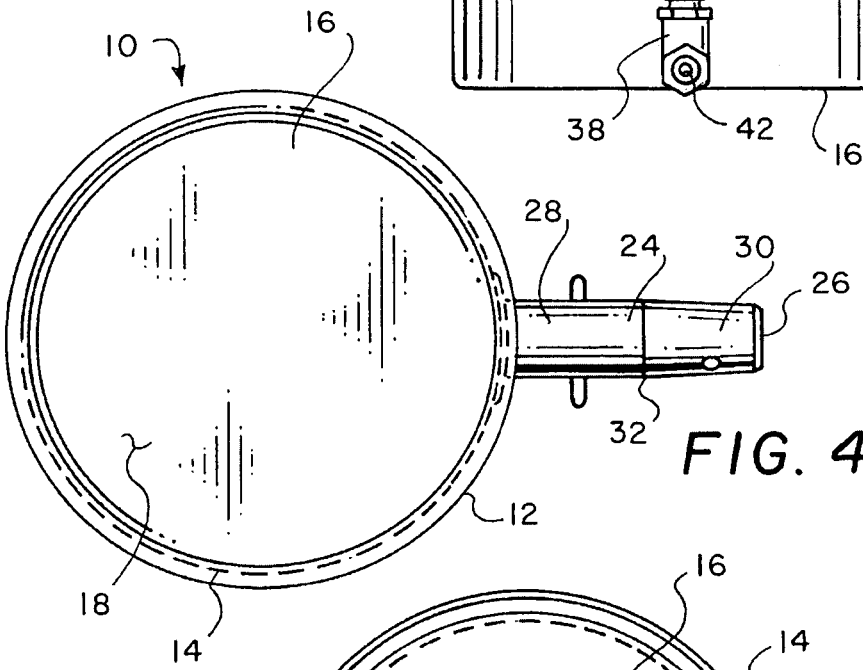
FIG. 4 is a top view of the Control Drip Mixer Attachment.
Figure 5:
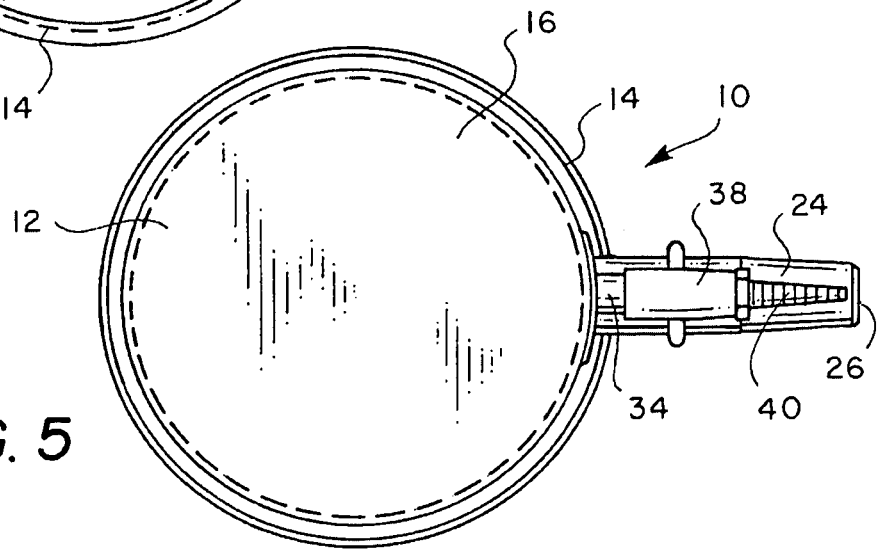
FIG. 5 is a bottom view of the Control Drip Mixer Attachment.
Figure 6:
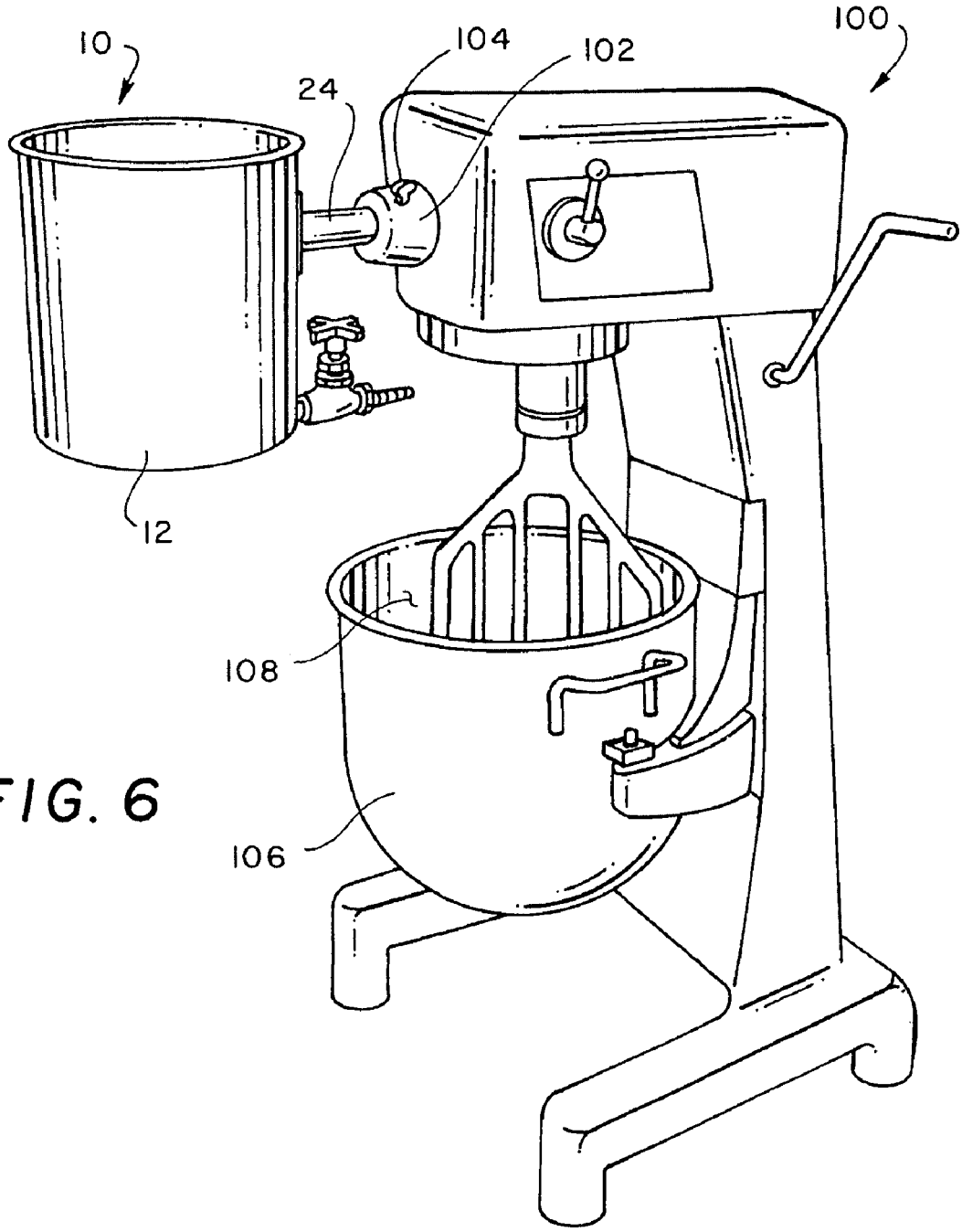
FIG. 6 is a perspective view of the Control Drip Mixer Attachment combined with a Hub Type commercial mixer.

Referring to FIGS. 1-6, where like numerals refer to like and corresponding parts, a Control Drip Mixer Attachment 10 is combined with a hub type food mixer 100 (FIG. 6). The Control Drip Mixer Attachment 10 includes an open-topped container 12 with a side wall 14 and a bottom wall 16 forming an interior 18 of the container.

Figure 2:
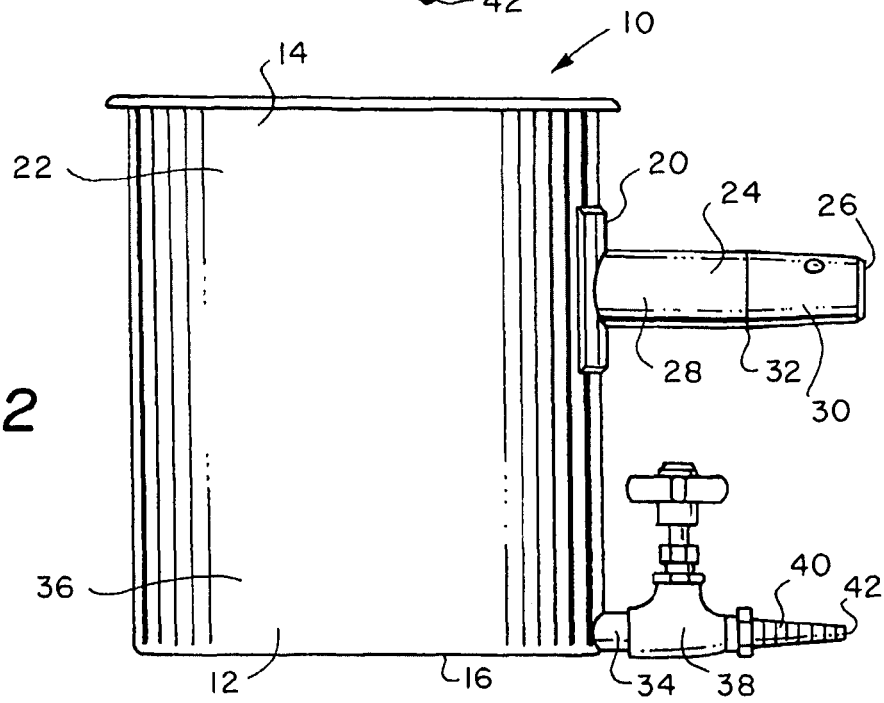
FIG. 2 is a side view of the Control Drip Mixer Attachment of FIG. 1.
Figure 3:
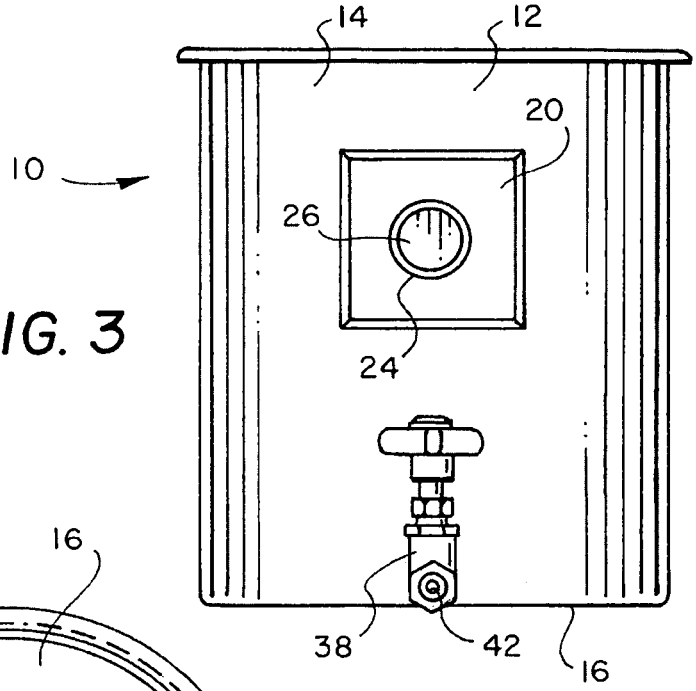
FIG. 3 is a front view of the Control Drip Mixer Attachment.

A reinforcing pad 20 is fixed to an upper section 22 of the side wall 14 of the container 12. A solid shaft 24 extends from the reinforcing pad 20 to a shaft end 26. The shaft 24 includes a cylindrical section 28 closest to the reinforcing pad 20 and a tapered section 30 closest to the shaft end 26 (FIGS. 2 and 4). The cylindrical section 28 and the tapered section 30 are joined at a medial location 32 on the shaft 24. The tapered section 30 tapers from the medial location 32 to a smaller dimension at the shaft end 26.

Figure 1:
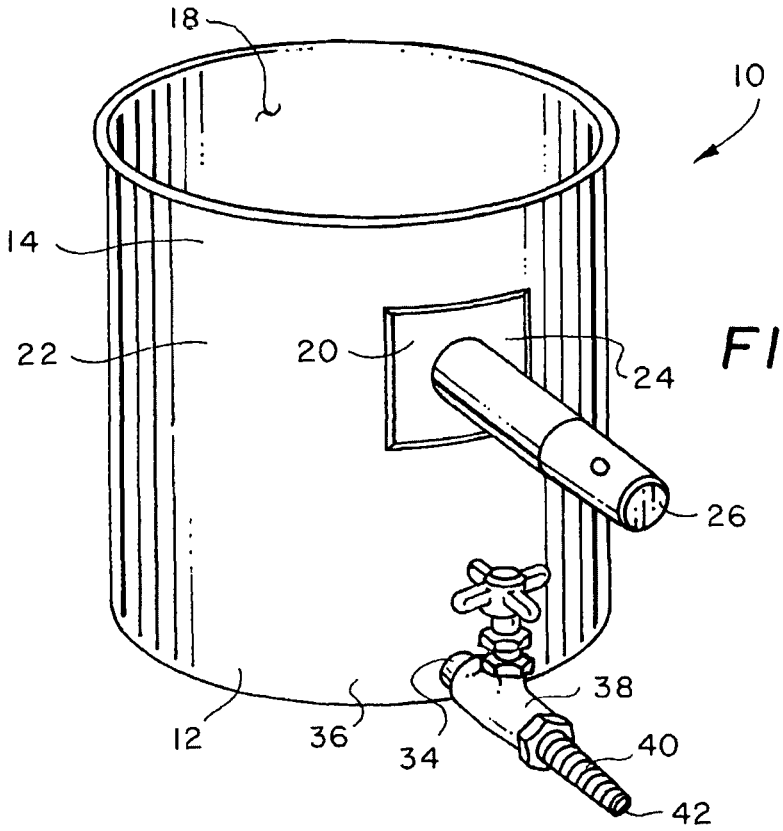
FIG. 1 is a perspective view of the Control Drip Mixer Attachment of the present invention.

A conduit 34 is fixed to a lower section 36 of the side wall 14 (FIGS. 1, 2 and 5). The conduit 34 is in fluid communication with the interior 18 of the container 12 at a location proximate the bottom wall 16. A valve 38 is in fluid communication with the conduit 34 and has an adjustable flow restriction. An outlet fitting 40 has an outlet opening 42 in fluid communication with the adjustable flow restriction of the valve 38.

The tapered section 30 of the shaft 24 is removably inserted into an opening in a hub section 102 of the mixer 100, with the shaft 24 being reversibly fixed to the hub section 102 by way of thumbscrew 104. Thus the hub section 30 supports the container 12 by way of the shaft 24.

The outlet opening 42 is disposed vertically above an open-topped mixer bowl 106 of the food mixer 100 to enable gravity flow of fluid from the outlet opening 42 to an interior 108 of the mixer bowl 106.

In one example of the invention, a precision type chrome steel faucet is attached to the bottom of a cylindrically shape round storage container. Once the Control Drip Mixer Attachment is installed to the mixer, the spout of the faucet will reside over the top of the mixing bowl with enough space clearance to not interfere with any of the mixer agitators.

In operation, the invention of this Control Drip Mixer Attachment makes it possible to consistently produce a quality product. It eliminates the inefficient and non-controlled manual process of adding ingredients to a mixing bowl while the mixer is in operation.

In a typical operation, the operator puts a certain amount of ingredients into the mixer bowl according to recipe instructions. The Control Drip Mixer Attachment is made ready for use by inserting its shaft into the attachment opening of the mixer hub. The shaft is secured by a thumb screw in the hub of the mixer. The Control Drip Mixer Attachment container will contain the ingredients that are to be blended into the ingredients in the mixer bowl to achieve a final product in the mixer bowl. Through the use of the Control Drip Mixer Attachment faucet, the rate of dripping flow is precisely set by the operator. This rate will vary depending on the ingredient and the final product desired. The mixer machine is turned on and the agitator begins stirring and mixing.

The controlled rate of flow into the bowl of the mixer is essential in producing a desired quality and quantity of certain sauces and dressings. The length of time of the operation will depend on the type and quantity of the final product desired. Once this process has started, the operator is free to do other tasks.

It will be understood that each of the elements described above, or two or more together, may also find a useful application in other types of constructions differing from the type described above.

While the invention has been illustrated and described as embodied in a particular mixer attachment, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A control drip mixer attachment in combination with a food mixer, comprising:

a food mixer with a hub section and an open-topped mixer bowl;

a control drip mixer attachment including an open-topped container with a side wall and a bottom wall forming an interior of the container;

a reinforcing pad fixed to an upper section of the side wall of the container;

a solid shaft extending from the reinforcing pad to a shaft end;

the shaft including a cylindrical section closest to the reinforcing pad and a tapered section closest to the shaft end;

the cylindrical section and the tapered section being joined at a medial location on the shaft;

the tapered section tapering from the medial location to a smaller dimension at the shaft end;

a conduit fixed to a lower section of the side wall, the conduit being in fluid communication with the interior of the container at a location proximate the bottom wall;

a valve fixed to the conduit, the valve being in fluid communication with the conduit and having an adjustable flow restriction;

an outlet fitting fixed to the valve, the outlet fitting having an outlet opening in fluid communication with the adjustable flow restriction of the valve;

the shaft, conduit, and outlet fitting extending in the same direction from the container side wall;

the tapered section of the shaft being removably inserted into an opening in the hub section of the mixer, with the shaft being reversibly fixed to the hub section; and the outlet opening being disposed vertically above the open-topped mixer bowl of the food mixer to enable gravity flow of fluid from the outlet opening to an interior of the mixer bowl.

2. A control drip mixer attachment in combination with a food mixer, comprising:

a food mixer with a hub section and an open-topped mixer bowl;

a control drip mixer attachment including a container, the container having a side wall and a bottom wall forming an interior of the container;

a shaft connected to the container;

the shaft being removably inserted into the hub section of the mixer, such that the shaft and container are supported by the hub section;

an outlet opening in fluid communication with interior of the container near the bottom wall of the container and vertically above the mixer bowl of the mixer;

with a conduit interposed between the container and the outlet opening, the conduit being fixed to a lower section of the side wall of the container, the conduit being in fluid communication with the interior of the container at a location proximate the bottom wall, and the outlet opening being in fluid communication with the conduit; and with the shaft and conduit extending in the same direction from the container side wall.

3. A control drip mixer attachment in combination with a food mixer, comprising:

a food mixer with a hub section and an open-topped mixer bowl;

a control drip mixer attachment including a container, the container having a side wall and a bottom wall forming an interior of the container;

a shaft connected to the container;

the shaft being removably inserted into the hub section of the mixer, such that the shaft and container are supported by the hub section;

an outlet opening in fluid communication with interior of the container near the bottom wall of the container and vertically above the mixer bowl of the mixer;

with a valve interposed between the container and the outlet opening, the valve being in fluid communication with the interior of the container at a location proximate the bottom wall, and the valve being in fluid communication with the outlet opening;

with the valve having an adjustable flow restriction, and an outlet fitting having an opening in fluid communication with the adjustable flow restriction of the valve; and with the shaft, conduit, and outlet fitting extending in the same direction from the container side wall.

* * * * *